US007681492B2

(12) United States Patent
Suggi Liverani et al.

(10) Patent No.: US 7,681,492 B2
(45) Date of Patent: Mar. 23, 2010

(54) INTEGRATED CARTRIDGE CONTAINING A SUBSTANCE FOR EXTRACTING A BEVERAGE

(75) Inventors: Furio Suggi Liverani, Trieste (IT); Luca Mastropasqua, Trieste (IT); Bruno Dellapietra, Duino Aurisina (IT); Sasa Smotlak, San Dorligo Della Valle (IT); Miran Levstik, San Dorligo Della Valle (IT)

(73) Assignee: Illycaffe' S.p.A. (IT)

( * ) Notice: Subject to any disclaimer, the term of this patent is extended or adjusted under 35 U.S.C. 154(b) by 633 days.

(21) Appl. No.: 11/506,008

(22) Filed: Aug. 17, 2006

(65) Prior Publication Data

US 2007/0062375 A1 Mar. 22, 2007

(30) Foreign Application Priority Data

Sep. 21, 2005 (EP) ..... 05020525

(51) Int. Cl.
*A47J 31/40* (2006.01)

(52) U.S. Cl. ..... 99/295; 99/323; 426/77; 426/80; 426/115

(58) Field of Classification Search ..... 99/295, 99/279, 323, 302 R; 424/77, 79, 115
See application file for complete search history.

(56) References Cited

U.S. PATENT DOCUMENTS

| | | | | |
|---|---|---|---|---|
| 4,077,551 | A | 3/1978 | Manaresi et al. | |
| 4,882,982 | A * | 11/1989 | Muttoni | 99/295 |
| 4,999,466 | A * | 3/1991 | Waligorski | 219/689 |
| 6,619,492 | B2 * | 9/2003 | Battegazzore | 215/21 |
| 2002/0078831 | A1 * | 6/2002 | Cai | 99/295 |
| 2002/0124753 | A1 * | 9/2002 | Hadden | 101/405 |
| 2005/0084569 | A1 | 4/2005 | Hu et al. | |
| 2005/0103204 | A1 * | 5/2005 | Halliday et al. | 99/295 |

FOREIGN PATENT DOCUMENTS

| | | |
|---|---|---|
| EP | 1 580 143 | 9/2005 |

OTHER PUBLICATIONS

European Search Report; EP 05 02 0525; Feb. 21, 2006.

* cited by examiner

*Primary Examiner*—Tu B Hoang
*Assistant Examiner*—Brian Jennison
(74) *Attorney, Agent, or Firm*—Cantor Colburn LLP

(57) ABSTRACT

A cartridge for extracting a beverage from an edible substance contained therein by means of a liquid under pressure, the cartridge comprising a main body having a cup portion and a lid portion. The base of said cup portion comprises a cup port defining a passage for the extracted beverage and protruding from the base outwardly with respect to the internal volume of the cartridge. Valve means are fixedly mounted on the internal surface of the cup port and are resiliently openable under pressure of the extracted beverage during a beverage extraction phase. The diameter of the open end of said cup port that is opposite to said cup base is sized so as to allow insertion of the valve means within the cup port. A safety cap is mounted on the external surface of the cup port and partially closes the external open end thereof.

19 Claims, 4 Drawing Sheets

INTEGRATED CARTRIDGE CONTAINING A SUBSTANCE FOR EXTRACTING A BEVERAGE

The present invention relates to an integrated cartridge containing a substance for extracting a beverage, where the substance may be any powdered or leaf or generally edible substance, such as ground coffee, instant coffee, tea, powdered chocolate or milk, soup, and the like.

BACKGROUND OF THE INVENTION

It is known that machines for extracting a beverage from a particulate substance usually require that the particulate substance is placed into a filtering receptacle installed in the machine. In particular, automatic or semiautomatic espresso coffee machines comprise a filtering receptacle, also called filter holder, in which a dose of ground coffee is placed before the extraction of coffee beverage takes place.

The general steps for extracting a coffee beverage in an espresso coffee machine, which are substantially equivalent to those of other automatic machines for preparing a beverage starting from an edible substance, comprise a phase of delivering hot water under suitable pressure into an extraction chamber which includes the filtering receptacle, followed by a brewing phase and a phase of conveying the brewed beverage into an external cup, jug or glass, ready to drink.

Ground coffee, as well as other edible substances for preparing beverages, is usually a single use substance, in that the organoleptic qualities such as taste, aroma and body of the brewed beverage are irremediably lost once ground coffee has been soaked. Accordingly, in espresso coffee machines and in other brewing machines the edible substance has to be removed after one single brewing. This is the reason why the filtering receptacle housing a dose of ground coffee is usually manually removable from the espresso coffee machine, in order to allow emptying of the receptacle from the used ground coffee and filling it with a new dose of ground coffee.

In order to facilitate the operations of filling and emptying the filtering receptacle, single serving pre-packaged tablets of ground coffee have been provided, consisting of a dose of ground coffee contained in a filtering paper bag or sachet, to be placed directly in a filter holder of the espresso coffee machine. These tablets comply with the so called Easy Serving Espresso (E.S.E.) standard. While this arrangement has resulted handy, it is affected by some drawbacks. In particular, the tablet is not air-tight and accordingly a second air-tight packaging must be provided for enclosing each dose, in order to keep the tablet uncontaminated from the external environment during storage.

Moreover, the user's hands come into contact with the tablet when the tablet is placed on the filter holder so that hygiene requirements are not fully assured.

In the past years, disposable capsules containing ground coffee have been also provided. Such capsules, generally having a frustum shape, are made of plastics or aluminum and provide a better air-tight barrier to the external environment than the filtering paper used in tablets.

Known capsules, such as the capsule disclosed in CH-A-605293, have a top surface that is pierceable by an injection needle/nozzle of the espresso coffee machine, in order to inject water under pressure inside the capsule, and a bottom surface comprising weakened zones which tear under pressure of percolation fluids. An internal filter is also provided inside the capsule for preventing solid substances from being ejected from the capsule together with the coffee beverage.

Other known capsules comprise a cylindrical body made of polypropylene, with a top and a bottom surface having a plurality of openings for distributing hot water throughout the dose of ground coffee, and comprising a sheet of paper filter for blocking passage of ground coffee outside the openings of the bottom surface during the extraction phase. These capsules have usually to be placed into a further packaging, such as a multilayered plastic sachet.

In order to prepare a beverage, the known capsules and cartridges are placed into a receptacle that constitutes an extraction chamber. During the extraction phase, the extraction fluid may come into contact with internal surfaces of the extraction chamber before definitively flowing out into the external cup. Such contact contaminates the extraction chamber as well as the filter holder and after a number of coffee extraction operations the quality of the beverage is greatly reduced, suffering from residuals and contaminants in the extraction chamber.

Accordingly, the extraction assembly, comprising the extraction chamber and the filter holder, has to be accurately cleaned after a certain number of coffee extraction operations; in addition, decalcification must be performed on a regular basis.

Even when such cleaning operations are regularly carried out, the fluid turbulence inside the extraction chamber of the machine or the insufficient fluid-tight seal at the opened top surface of the capsule during water injection causes either the extracted beverage or the injected water to lap portions of the external surface of the capsule itself, thus jeopardizing the extraction hygiene requirements.

Another important drawback of known capsules is that they may not retain percolation fluid residuals inside the capsule, in that perforations or openings on the top surface and/or on the bottom surface of the capsules provide for an escape for fluid residuals when the extraction is terminated and/or when the capsule is removed from the machine, causing the capsule to drip and dirty the surroundings of the coffee machine.

Moreover, the beverage obtained from the known capsules is usually easily recognizable by the user as not being a beverage obtained using conventional means, e.g. espresso coffee machines used in bars or pubs, as organoleptic features such as taste, aroma or body, which define the quality of a beverage, are different and even small deviations from the standard quality can be easily perceived during drinking. By way of example, if the beverage is espresso coffee, the cream layer on top of the extraction beverage, which is usually identified with the Italian term "crema", is immediately felt by the user. If crema is missing, or has a reduced volume or a short life or a pale colour, or it is composed of too large bubbles, the espresso coffee is, even visually, identified as being not good or as a less than optimal espresso, whose quality is below expectation.

SUMMARY OF THE INVENTION

Aim of the present invention is to overcome the drawbacks of prior art cartridges and capsules by providing a cartridge for producing a high quality beverage having improved organoleptic qualities, particularly when the beverage extraction machine is an espresso coffee machine.

Within the scope of this aim, an object of the present invention is to provide a cartridge structure that allows easy and quick manufacturing thereof as well as a safe operation during the beverage extraction phase.

A further particular object is to greatly reduce or eliminate contamination of any component of machines for producing a beverage from a particulate substance and to provide a universal beverage extraction system that takes advantage of its contamination-free structure for allowing consecutive extractions of beverages from different kinds of edible substances.

Another object of the present invention is to guarantee a high level of preservation of the particulate substance inside the cartridge until the cartridge is inserted into the beverage extraction machine, reducing contamination of the particulate deriving from the external environment.

Yet another object is to simplify use of the cartridge, reducing the number of operations to be carried out for preparing the cartridge to insertion into a beverage extraction machine.

Not least object of the invention is to provide a low-cost cartridge that can be easily manufactured using conventional techniques and in a short time.

This aim, these objects and others which will become apparent hereinafter are achieved by a cartridge comprising a main body having a cup portion and a lid portion, the cup portion comprising a base, a sidewall and a rim opposed to the base, the lid portion being fixedly attached to the rim of the cup portion so as to define an internal volume of the cartridge, the internal volume of the cartridge housing an edible substance, the lid portion comprising a lid port defining a first passage for the liquid under pressure and the base of the cup portion comprising a cup port defining a second passage for the extracted beverage, the cup port protruding from the base outwardly with respect to the internal volume and comprising valve means which are fixedly mounted on the internal surface of the cup port and which are resiliently openable under pressure of the extracted beverage during a beverage extraction phase, wherein a safety cap is secured to the cup port, preferably to the external surface thereof.

The above aim and objects are also achieved by a cartridge for extracting a beverage from an edible substance contained therein by means of a liquid under pressure, the cartridge comprising a main body comprising a cup portion and a lid portion, the cup portion comprising a base, a sidewall and a rim opposed to the base, the lid portion being fixedly attached to the rim of the cup portion so as to define an internal volume of the cartridge, the internal volume of the cartridge housing the edible substance, the lid portion comprising a lid port defining a first passage for the liquid under pressure and the base of the cup portion comprising a cup port defining a second passage for the extracted beverage, characterized in that the cup port protrudes from the base outwardly with respect to the internal volume, and in that the cup port comprises valve means which are fixedly mounted on the internal surface of the cup port, preferably by means of snap-fit means, and which are resiliently openable under pressure of the extracted beverage during a beverage extraction phase, the diameter of the open end of the cup port that is opposite to the cup base being sized so as to allow insertion of the valve means within the cup port.

BRIEF DESCRIPTION OF THE DRAWINGS

Further characteristics and advantages of the invention will become better apparent from the following description of preferred but not exclusive embodiments, illustrated by way of non-limitative embodiments in the accompanying drawings, wherein.

DESCRIPTION OF THE PREFERRED EMBODIMENTS

Figure 1:
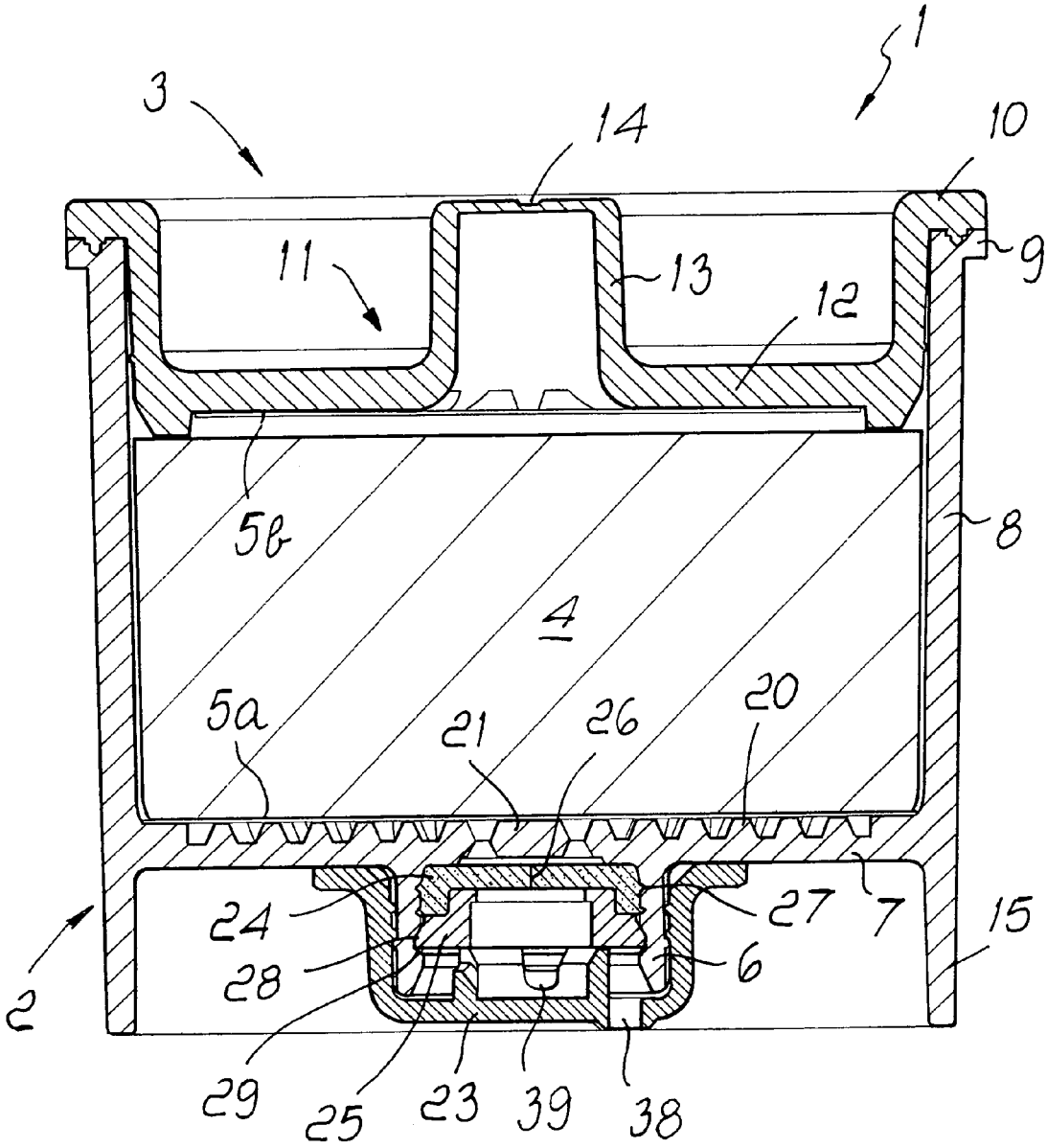
FIG. 1 is a cross-sectional front view, taken along an axial plane, of the cartridge according to the invention.

With reference to the figures, a cartridge 1 is shown according to a preferred embodiment of the present invention. The cartridge has a substantially cylindrical shape and comprises a cup portion 2 and a lid portion 3 fixed thereon so as to define an internal volume of the cartridge 1. The internal volume of the cartridge houses a dose 4 of an edible substance, preferably ground coffee, which is sandwiched between two filtering means 5*a* and 5*b*. The filtering means 5*a* and 5*b* may be sheets of paper filter or of tissue filter. In the figures, the dose 4 is schematically shown as a cylinder, but it is straightforward to understand that the edible substance is evenly distributed within and may completely fill the internal volume of the cartridge.

The cup portion 2 comprises a base 7, a substantially cylindrical sidewall 8 extending from the base 7 and a rim 9, which is disposed substantially opposite to the base 7 and defines an open end of the cup portion 2. The sidewall 8 is slightly tapered from the base 7 toward the rim 9 and, preferably, the inclination between the generatrix of the sidewall and the axis of the cartridge is about 1-2 degrees.

The lid portion 3 is shaped so as to fit with the open end of the cup portion 2 and comprises a rim 10, for engagement with the corresponding rim 9 of the cup portion 2, and a lid base 11 which is recessed with respect to the rim 10. The lid base 11 comprises, on a lower side thereof, a plurality of radial ribs 12, for providing a support for the upper filtering means 5*b* and a hollow space between the upper filtering means and the lid base, for substantially radially distributing input water.

A lid port 13 protrudes from a central area of the lid base 11 outwardly with respect to the internal volume of the cartridge, so as to form an inlet spout that allows passage of fluid injected into the cartridge. The lid port 13 has a substantially cylindrical shape and is preferably closed at an upper end thereof, where a weakened line 14 is provided for facilitating rupture, during the extraction phase, of the closed upper end of the lid port by means of a needle such as a needle of an espresso coffee machine, not shown in the figures.

In alternative embodiments of the invention, the lid port 13 may have an open upper end which is sealed by a plastic film or a rubber plug. The lid port may be also sealed by means of edible solid substances (e.g. polysaccharides, proteins and lipids) that are air-impermeable and water soluble or that melt at the temperature of the inlet water.

The entire cartridge may be optionally kept in a sachet or packaging to be manually opened before use. The sachet or packaging may be made of a polylaminate vacuumed or filled with an inert gas under pressure (such as in Modified Atmosphere Packaging or MAP techniques).

According to yet other embodiments, the lid port may not protrude from the lid base. However, a protruding lid port is the preferred one as it can provide a fluid-tight seal if coupled with an O-ring tightly surrounding the external surface of the lid port and radially abutting against the internal surface of the chamber or tube from which water is injected into the cartridge, as it will be shown with reference to FIG. 5. This arrangement eliminates any possible contamination of the extracted beverage as water would be injected only into the cartridge without lapping any portions of its external surface.

The axial distance between the lid base 12 and the rim 10 is substantially equal to the height of the lid port 13. However, this is a preferred arrangement and the distance between the lid base and the rim 10 may be different, according to circumstances. Moreover, according to alternative embodiments of the invention, which are not shown in the figures, the lid portion 3 may be generally planar or may even have a convex shape.

Figure 2:
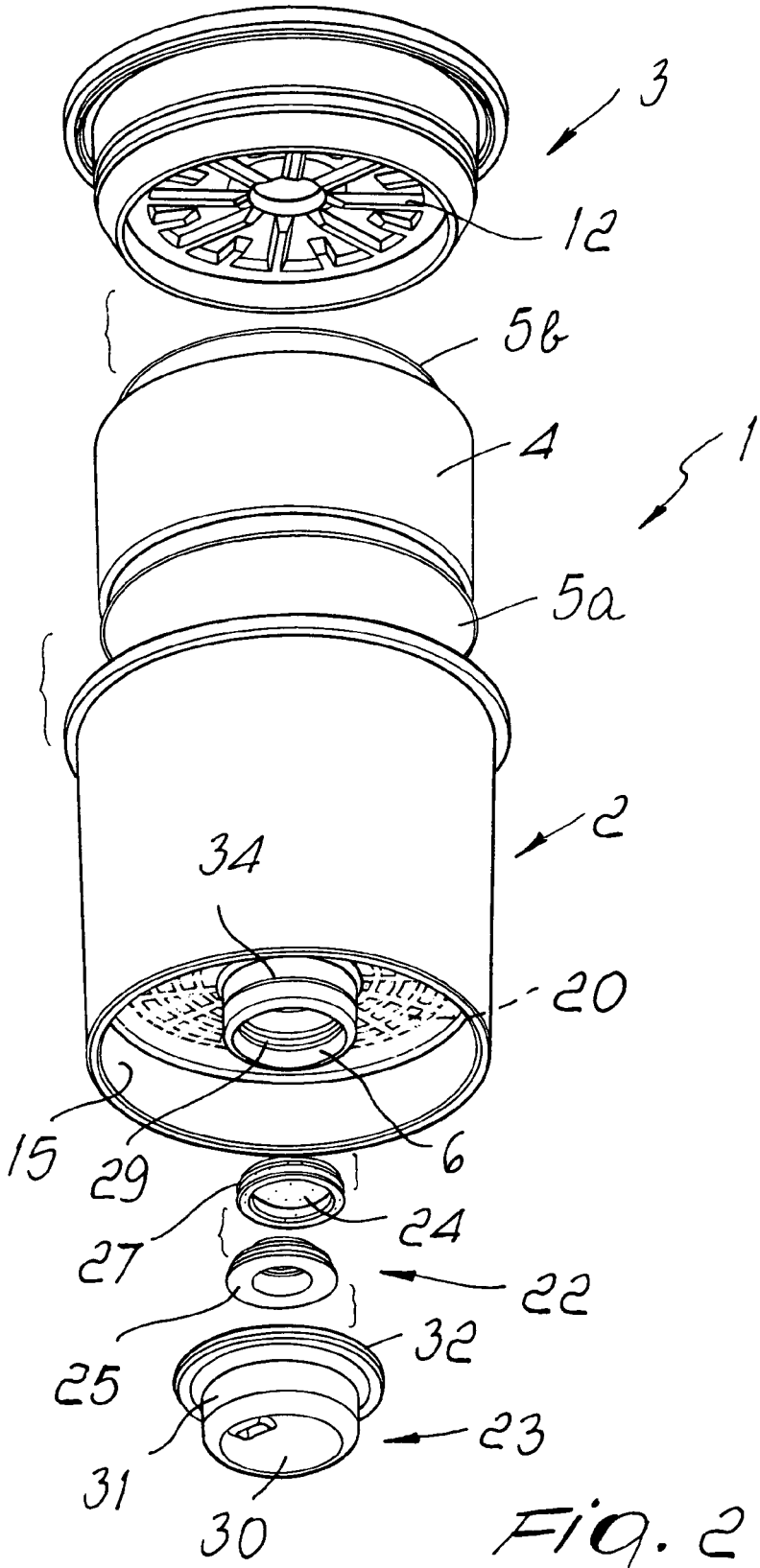
FIG. 2 is a perspective, exploded view of the cartridge according to the invention.

The cup base 7 is recessed with respect to the bottom edge of the cup portion 2 and comprises a cup port 6 in a central region thereof, which port protrudes outwardly from the internal volume of the cartridge and forms an outlet spout, for delivering the extracted beverage directly into an external cup or glass without contaminating any part of the extraction machine, such as the extraction chamber or the filter holder. As shown in FIG. 2, the cup port 6 has a substantially cylindrical shape and provides an open access to the internal volume of the cartridge, thus allowing passage of the extracted beverage.

The inner surface of the cup base 7 comprises a plurality of concentric, arc-shaped ridges 20, which support the lower filtering means 5*a* and define a fine canalization formed by a plurality of concentric channels and radial channels for conveying the extracted beverage toward the cup port 6.

Central ridges 21 are located at the periphery of the base of the cup port 6 and are shaped so as to cross the aperture provided by such base. These ridges 21 form bridges which both support the lower filtering means 5*a* and allow passage of the extracted beverage, although reducing the overall aperture size at the base of the cup port 6.

The cup portion 2 is shaped so as to comprise a flange 15, aligned with the sidewall 8 and protruding outwardly with respect to the internal volume of the cartridge. Such flange 15 is preferably provided in order to end up with a protruding shape facilitating and promoting handling and automated production processes. Furthermore the cartridge can be placed in a horizontal position on a table surface without tilting or rolling, it can be packaged and stacked more easily and it can also be "strip" packaged, i.e. fixed and sealed between two strips of polylaminate films.

As it will be explained hereinafter, the flange 15 also prevents easy and inadvertent access to the cup port.

In preferred embodiments, the lid portion and the cup portion are welded to each other at rims 9 and 10 using an ultrasonic shear-welding or a conventional ultrasonic welding techniques. It is immediately apparent to the skilled in the art that, alternatively, other known welding techniques can be used for fixing the lid portion 3 to the cup portion 2, for instance hot welding, bonding and so on. The cartridge according to the invention may also be manufactured as a single moulded piece.

Figure 4:
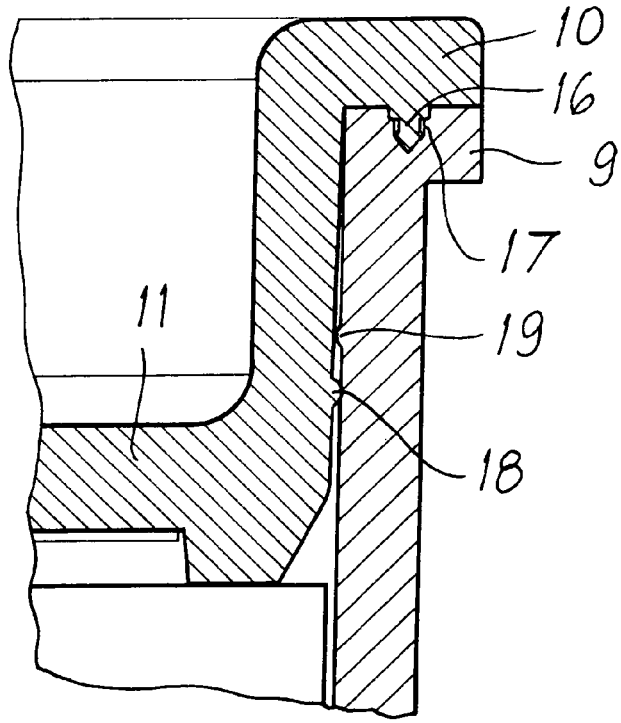
FIG. 4 is an enlarged view of the welding region of the cartridge of FIG. 1.

In order to facilitate welding, the lower side of rim 10 comprises a ring 16 which is coaxial with the rim 10 and protrudes from the lower side of the rim 10, for allowing insertion into a corresponding annular recess 17 provided on the upper portion of the rim 9 (FIG. 4). The ring 16 advantageously has a T-shaped cross section so that, during ultrasonic welding, the tip end of the stem and the two lateral portions of the "T" melt first and then fill any hollow spaces within the annular recess 17.

It is noted that the recessed position of the lid base 12 allows to dissociate the welding regions away from the edible substance housed within the cartridge, thus minimizing interference between migrating substance particles and the plastic weld, which might compromise its tight sealing characteristics.

Advantageously, in order to prevent particles of the edible substance 4 from migrating toward the welding regions 16 and 17 of the cartridge, an annular protrusion 18 is provided around the lid portion, which radially abuts against the inner side of the sidewall 8 of the cup portion 2 when the lid portion 3 is inserted into the open end of the cup portion 2. For the same purpose, a second annular protrusion 19 is also preferably provided on an upper portion of the inner surface of the sidewall 8, so as to radially abut against the external surface of the lid portion 3.

Returning to FIG. 1, the cartridge according to the invention comprises a valve means 22 within the cup port 6, which is advantageously closed by a cap 23.

More in detail, the valve means 22 is engaged with the internal surface of the cup port, which is substantially cylindrical as stated above.

The valve means comprises an elastic pad or septum 24 stacked above an annular support 25 which is substantially rigid.

Figure 5:
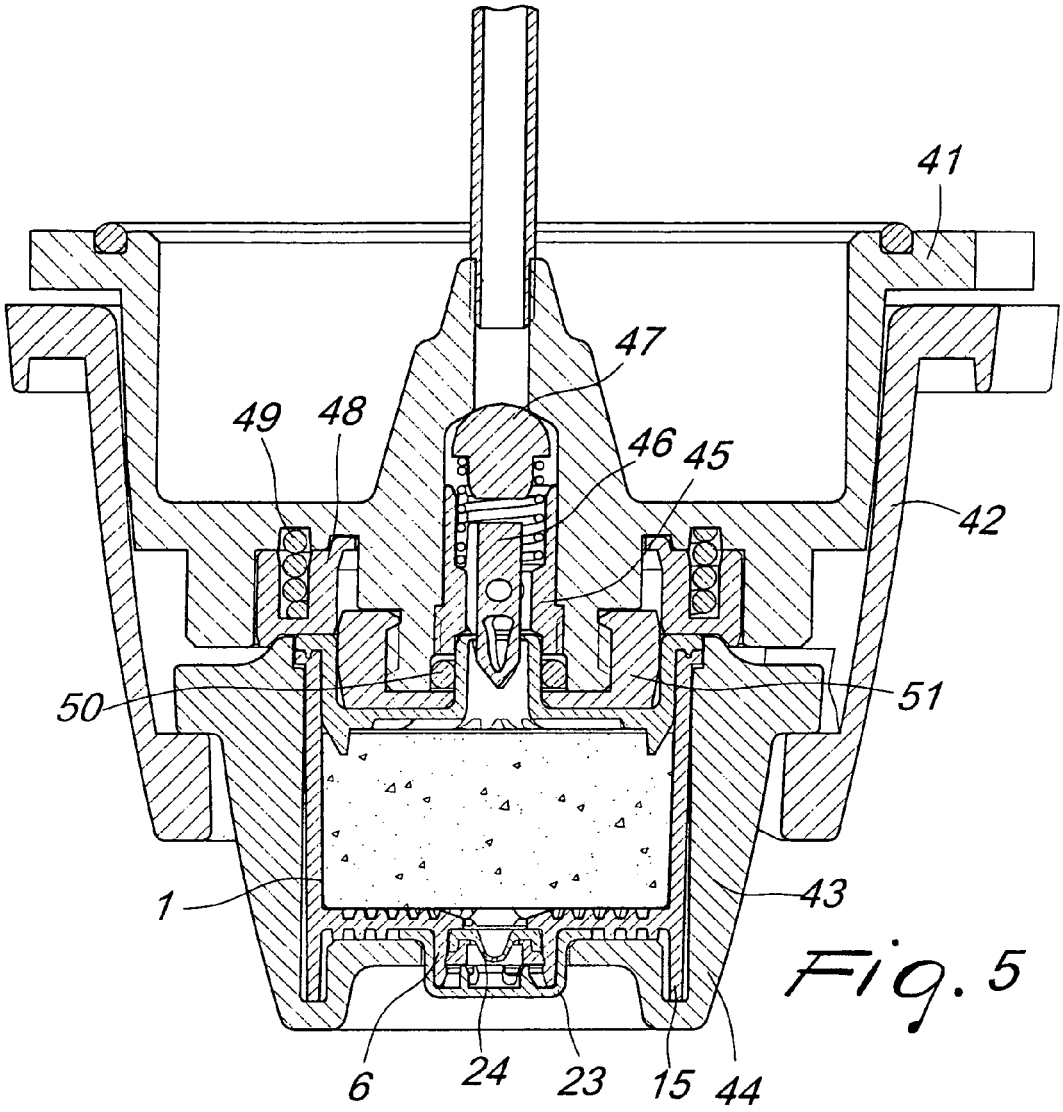
FIG. 5 is a cross sectional view of an extraction assembly for use with the cartridge according to the invention.

The septum 24 may be any one of a rubber-like, elastomeric or plastic pad or disc having a narrow through slit or orifice 26 formed therein and connecting a top surface to a bottom surface of the pad. If no axial pressure is applied to the septum, the orifice provides for an air-tight seal, whereas if pressure is applied, such as the pressure of the beverage extracted from the edible substance 4, a portion of the septum warps and the slit slightly widens such as shown in FIG. 5, thus allowing passage of the beverage. For this reason, the inner diameter of the annular support 25 is wide enough to allow downward warping of a central region of the septum during the extraction of beverage.

Since the orifice 26 is preferably obtained by piercing the septum with a fine needle, whose sharpness may degrade over time and may not always produce a completely through orifice, the septum 24 may optionally comprise more than one orifice 26 as a precautionary measure, should one or more orifices result blind after piercing.

The diameter of the orifice 26 diameter is very small, e.g. in the order of 0.1 to 0.5 mm when it is in the open condition. This assures a very good conservation of the edible substance within the cartridge and also prevents the extracted beverage to drip out of the cartridge once the extraction phase is ended.

Forcing the extracted beverage through the septum has been found to greatly increase the density and the stability of the crema when the cartridge is used for extracting espresso coffee. This effect is a very advantageous one since, through the integration of a means of a relatively light weight and of simple nature such as the septum 24, it is possible to achieve an important effect that characterizes the quality of an espresso coffee beverage.

Moreover, since the cartridge is generally a disposable one, it is guaranteed that the extracted espresso coffee always has a layer of crema of the best quality, contrary to known espresso coffee machines in which the devices that enhance the formation of crema are part of the machines themselves, they are used for a great number of extraction processes and necessarily deteriorate the quality of the extracted coffee over time.

The septum 24 is sized so as to guarantee a fluid-tight seal in the radial direction within the cup port 6 and, to this aim, the diameter of the septum is preferably equal to or larger than the inner diameter of the cup port. Annular ribs 27 are advantageously provided around the lateral surface of the septum 24 for optimizing the fluid-tight seal.

It is straightforward to the skilled in the art that the valve means may comprise only an elastic septum and no support, without departing from the scope of the invention.

In order to fix the valve means 22 within the cup port 6, the annular support preferably comprises a radially enlarged region 28 for engagement with a corresponding annular recess 29 provided on the inner surface of the cup port, such region 28 and recess 29 forming snap-fit coupling.

Obviously, the valve means 22 may be fixed to the cup port in various ways, which are clearly in the reach of the person skilled in the art. For instance, tooth-hole or threaded couplings may be provided in the alternative.

However, snap-fit couplings 28, 29 such as those described above are preferred since they greatly simplify manufacturing of the cartridge.

In particular, the diameter of the open end of the cup port that is opposite to the cup base is substantially equal to the inner diameter of the cup port. Therefore, such diameter is sized so as to allow insertion of the valve means 22 within the cup port 6 directly from the outside of the cartridge, although a small elastic deformation of either the cup port or the support 25 may occur when inserting the valve means into the cup port, because of the diameter of the support 25 at its enlarged region 28.

However, this arrangement speeds up manufacturing of the cartridge, as insertion of the valve means can be performed independently of other manufacturing operations such as filling of the cartridge with the edible substance. Moreover, insertion of the valve means from the outside of the cartridge is simple as the protruding cup port is suitable to be easily handled and identified by an automatic machine.

Figure 3:
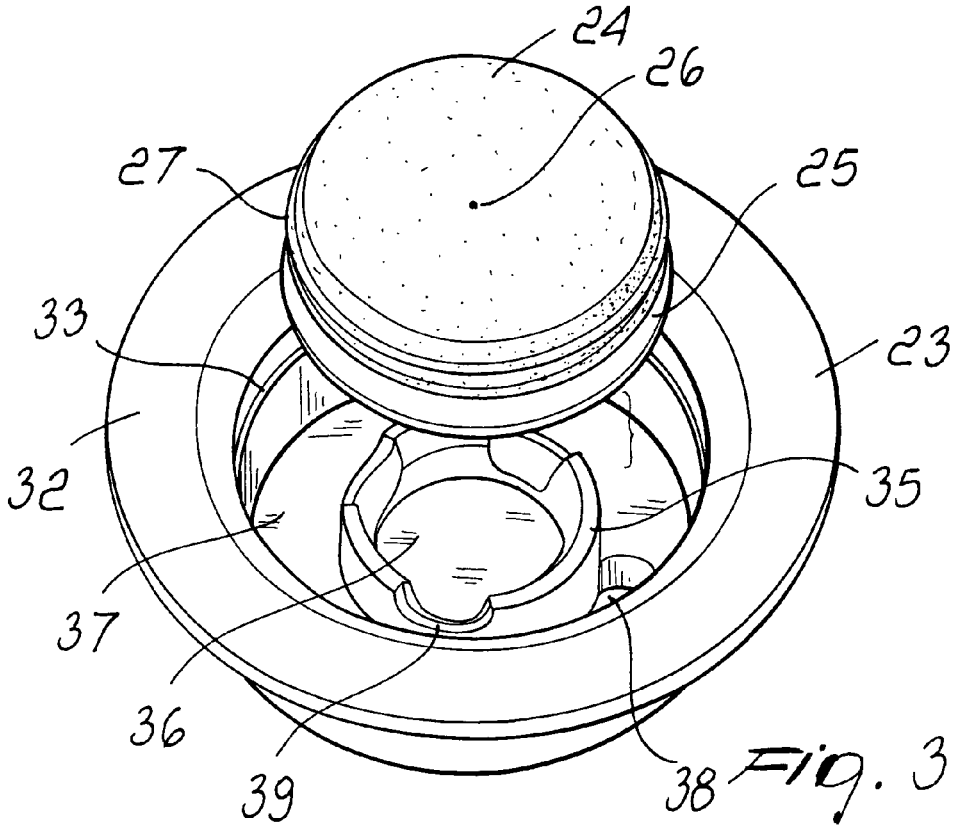
FIG. 3 is a perspective, exploded view of the septum and the cap of the cartridge according to an embodiment of the invention.

A further preferred feature of the invention is the safety cap 23, which will be now described with reference to FIGS. 3 and 6, which show two different implementations of the same cap 23. In these figures, like reference numerals indicate like parts.

Cap 23 has a generally U-shaped cross section and comprises a base 30, a substantially cylindrical sidewall 31 and an outwardly flared rim 32.

At least one annular rib 33 (FIG. 3) or, more preferably, two annular ribs 33*a* and 33*b* (FIG. 6) are provided on the inner surface of the sidewall 31 for engaging with a corresponding external annular rib 34 of the cup port 6, so that the cap can be easily attached to the cup port 6 during manufacturing of the cartridge 1. The ribs 33*a* and 33*b* are provided in an upper position of the inner surface of the sidewall 31 so that they are closer to the cup base 7 than the rib 34 when the cap 23 is mounted on the cup port 6, as shown in FIG. 1, so that the lower rib 33*b* can abut against the rib 34 of the cup port during the beverage extraction phase. A double or multiple provision of ribs on the inner surface of the cap sidewall 31 is preferred as it allows a safer fixing of the cap 23 to the cup port 23 in case of overpressure during extraction of beverage. Upper ribs such as rib 33*a* will keep the cap secured to the cup port, if the fixing provided by lower rib 33*b* accidentally fails and the cap 23 is lowered as a consequence thereof.

Obviously, one or more recesses may be provided on the inner surface of the sidewall 31 of the cap as an alternative fixing means that engages with the corresponding rib 34 of the cup port. Similarly, one or more recesses may be alternatively provided on the external surface of the cup port, for engaging with corresponding ribs provided on the inner surface 31 of the cap.

It is clear that any other alternative means can be provided for securing the cap to the cup port. For instance, the cap may be welded to the outer surface of the cup port using conventional ultrasonic welding techniques.

The cap 23 comprises an inner cylindrical wall 35 that protrudes from the base 30 coaxially with the external sidewall 31 and which defines a first area 36 and a second annular area or annulus 37 of the base. The annular area 37 also comprises a bottom aperture 38 for allowing passage of the extracted beverage. It is noted that the cap aperture 38 is radially displaced with respect to the central axis of the cap and the cartridge.

More than one bottom aperture 38 can be provided for allowing passage of the extracted beverage through the cap 23: for instance, four apertures each having an angular aperture of about 30° may be included in the annular area 37. More preferably, if a plurality of apertures 38 is provided, the apertures are preferably displaced so as to be adjacent one to another.

A cap having a single aperture 38 is preferred for low flows of extracted coffee beverage ("Italian" espresso coffee), e.g. a weight of about 0.5-1.5 g of espresso coffee beverage per second.

Instead, a plurality of apertures 38 is preferred for higher flows of extracted beverage, e.g. a weight of more than about 1.5 g of coffee beverage per second.

The inner wall 35 is preferably sized so as to abut against the support 25 of the septum 24 when the cap is mounted on the cup port of the cartridge and comprises at least one vertical aperture 39 for allowing passage of the extracted beverage from the inside to the outside of the volume surrounded by the inner cylindrical wall 35. In particular, apertures 39 connect a first chamber, enclosed within the first area 36 of the base, the inner sidewall 35, the support 25 and the septum 24, to a second annular chamber, enclosed within the second annular area 37 of the cap base, the inner sidewall 35, the support 25 and at least one of the sidewall of the cup port 6 or the external sidewall 31 of the cap.

Figure 6:
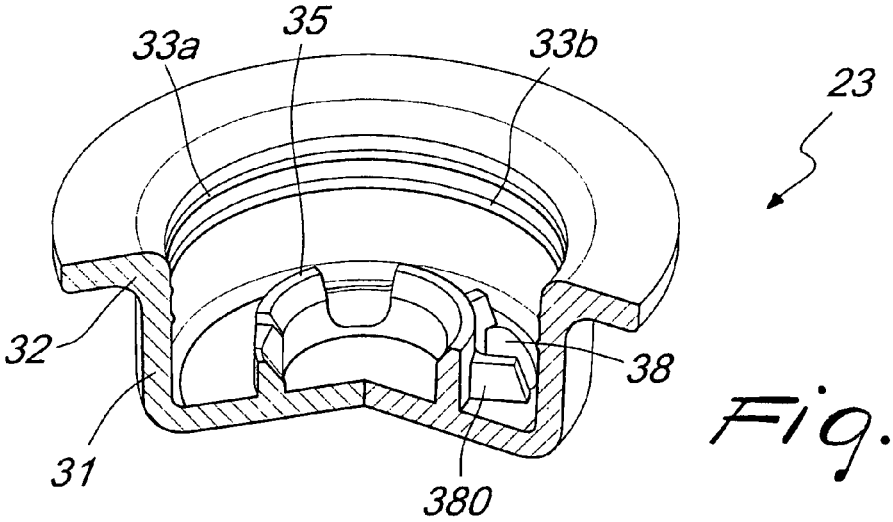
FIG. 6 is a cutaway view of a second implementation of the safety cap of the cartridge according to the invention.

According to a particular embodiment of the invention, two radially directed vertical walls 380 are provided which protrude from the cap base within the second annular area 37 and at opposite sides of the bottom aperture 38 of the cap, as shown in FIG. 6. The vertical walls 380 have a height which does not prevent the passage of beverage toward the bottom aperture 38.

As anticipated above, in the embodiments where the cap 23 comprises more than one bottom aperture 38, the bottom apertures 38 are adjacent one to another within the annulus 37. In this case, the bottom apertures 38 preferably alternate with such vertical walls 380 and the inner wall 35 preferably comprises only one vertical aperture 39, in a position opposite to the region where the adjacent bottom apertures 38 are displaced.

The cap 23 has many advantageous functions. The first function of the cap is to act as a buffer means, for regulating the outflow of beverage. In particular, during the extraction phase, the beverage passing through the orifice 26 hits the central area 36 of the cap and is directed toward the annular chamber by means of the apertures 39. Then, the beverage is conveyed toward the bottom aperture 38 of the cap and can be finally collected into an external cup for drinking. The walls 380 advantageously allow a more stable vertical outflow of the beverage.

Moreover, the cap 23 is an additional safety means for keeping the valve means 22 within the cup port 6, thus avoiding accidental ejection of the valve means from the cartridge during beverage extraction. Fixing of the valve means 22 to the inner surface of the cup port may be even avoided because of the action of the cap.

It is also noted that the cap 23 can be mounted on the cartridge without angularly orienting the cap with respect to the cartridge. Moreover, the provision of a peripheral flange 15 around the cup port 6 makes it difficult for a user to manually remove the cap 23.

The cartridge 1 and the cap 23 are preferably made of polypropylene and are manufactured using known injection moulding techniques. Anyway, this cartridge as well as any cartridge according to the invention may be made of any material such as: other thermoplastic materials, for instance PET; elastomeric-thermoplastic materials or TPEs, for instance, SANTOPRENE, i.e. a mixture of non interlaced EPDM and polypropylene; thermosetting compositions, for instance, a polyester; rubbers or elastomers, for instance, silicone or MVQ; polylaminate thermoplastic materials, for instance a composite sheet made of PE, PET and PVDC; aluminium; other polylaminate materials, for instance, a composite sheet made of PE, PET and aluminium.

Preferably, the annular support 25 is made of polypropylene and the septum 24 is made of a SEBS rubber (Styrene-Ethylene/Butylene-Styrene), such as LAPRENE. In order to assure a tight coupling therebetween, the septum 24 is moulded directly on the support 25.

The main body of an exemplary cartridge such as the one depicted in FIG. 1 is, for instance, 30-35 mm high and 35-40 mm wide, and the lid port and the cup port are about 7-8 mm high and 8-10 mm wide, respectively. However, the skilled in the art readily understands that the size of the cartridges according to the invention may be different, according to the extraction requirements and the structure of the beverage extraction machine.

With reference to FIG. 5, an extraction assembly suitable for the cartridge according to the invention comprises a support connectable to an espresso coffee machine, which is preferably composed of a connector member 41, for connecting the extraction assembly to the water injection tube of the beverage extraction machine, and a bayonet holder 42. The bayonet holder 42 comprises a bottom open end on which guides of a known kind are provided for bayonet fitting with a filter holder 43, which is provided with a grip handle (not shown).

The base of the connector member 41 comprises a central, protruding inlet port connectable to the water outlet (injector) of a beverage extraction machine and, on the opposite side of the base, a circular recess housing an annular cartridge ejector 48, which is used for keeping the cartridge inside the filter holder 43 when the filter holder is removed from the bayonet holder 42. In particular, a helical spring 49 is provided for pushing the ejector 48 toward the rim 10 of the cartridge, thus leaving a small contact surface between the ejector and the cartridge.

The receptacle or filter holder of the extraction machine in which the cartridge according to the invention may be mounted is preferably internally shaped so as to fit with and be complementary to the external shape of the cup portion. In particular, the receptacle or filter holder 43 has a substantially cylindrical internal shape and comprises an annular groove 44, into which the flange 15 of the cartridge fits slidingly. Moreover, the receptacle or filter holder comprises an aperture on the bottom portion thereof for allowing insertion of the cup port and the cap 23, so that the extracted beverage can flow out directly into an external cup without lapping any internal surfaces of the filter holder. When the cartridge is placed into the filter holder 43, the flange 32 of the cap 23 advantageously abuts against the edge region of the bottom aperture of the filter holder 43, so that the cap is kept and firmly secured against the cartridge base during the beverage extraction phase. Projections may be advantageously provided on either the filter holder base or the cartridge base (as shown in FIG. 5) so as to avoid bending of the cartridge base during the beverage extraction phase.

A nozzle assembly is mounted within the central inlet port of the connector member 41 of the extraction assembly in a coaxial relationship to the cartridge receptacle within the filter holder 43. The nozzle assembly comprises a hollow nozzle body 45 and a piercing member or needle 46 fixedly mounted to the inner surface of the nozzle body 45. The arrangement of the nozzle assembly allows the lid port of the cartridge to be pierced by the needle 46 upon securing the filter holder 43 to the bayonet holder 42.

The nozzle assembly further comprises, on an upper portion thereof, a valve 47, which normally closes the passage between the water injector of the extraction machine and the nozzle assembly through the action of a spring that maintains the valve 47 in the closed position, as shown in FIG. 5. The valve 47 can be lowered by the inflow of water from the injector during the beverage extraction phase.

Advantageously, a nut 51 is mounted on the connector member 41 and surrounds the nozzle assembly so as to define a receptacle of an O-ring 50, which is coaxial to the nozzle assembly and radially abuts against the external surface of the lid port 13 of the cartridge, thus preventing the inlet water from penetrating within the extraction chamber and contaminating the internal components and surfaces of the extraction assembly. The nut 51 also defines a support surface for the base of the lid portion of the cartridge that prevents possible bending of the lid portion because of the pressure within the cartridge.

It has thus been shown that the present invention fulfils the proposed aim and objects. Clearly, several modifications to either the cartridges and the extraction assembly according to the invention will be apparent to and can be readily made by the skilled in the art without departing from the scope of the present invention. Therefore, the scope of the claims shall not be limited by the illustrations or the preferred embodiments given in the description in the form of examples, but rather the claims shall encompass all of the features of patentable novelty that reside in the present invention, including all the features that would be treated as equivalents by the skilled in the art.

The disclosures in European Patent Application No. 05020525.1 from which this application claims priority are incorporated herein by reference.

What is claimed is:

1. A cartridge for extracting a beverage from an edible substance contained therein by means of a percolation fluid under pressure, the cartridge comprising:

a main body comprising a cup portion and a lid portion, the cup portion comprising a base, a sidewall and a rim opposed to said base, the lid portion being fixedly attached to said rim of the cup portion so as to define an internal volume of said cartridge, the internal volume of said cartridge housing the edible substance, said lid portion comprising a lid port defining a first passage for said liquid under pressure and the base of said cup portion comprising a cup port defining a second passage for the extracted beverage, wherein said cup port protrudes from said base outwardly with respect to said internal volume, the cup port comprising valve means which are mounted within the cup port and which are resiliently openable under pressure of the extracted beverage during a beverage extraction phase, a safety cap which partially closes an external open end of said cup port being secured to the cup port at an external surface thereof, said cap comprises a base and a sidewall, the cap base of said cap partially closing said open end of the cup port and the cap sidewall being fixed to the external surface of the cup port, the base of said cap comprising an inner cylindrical wall which protrudes from the base of the cap and is coaxial to the cap sidewall, said inner cylindrical wall defining a first area and a second annular area of the base, the second annular area comprising at least one bottom aperture for allowing passage of the extracted beverage, the inner cylindrical wall being sized so as to abut against a support of the valve means and comprising at least one aperture for allowing passage of the extracted beverage from the inside to the outside of the volume surrounded by said inner cylindrical wall.

2. The cartridge of claim 1, wherein the valve means are fixedly mounted on the internal surface of the cup port by means of a snap-fit means, the diameter of the open end of said cup port that is opposite to said cup base being sized so as to allow insertion of said valve means within the cup port.

3. The cartridge of claim 1, wherein said valve means are normally closed when no pressure of said percolation fluid substances is applied, so as to insulate the internal volume of said cartridge from external environment when said cartridge is not installed into a beverage extraction machine.

4. The cartridge of claim 1, wherein said valve means are resiliently closable as soon as said pressure of percolation fluid substances drops due to a termination of said beverage extraction phase, so as to retain fluid residuals inside said internal volume.

5. The cartridge according to claim 2, wherein said valve means comprise a septum of a material selected from the group comprising rubbers, elastomers, flexible plastics, said septum comprising a through orifice that is normally closed, for insulating the internal volume of said cartridge from external environment and for retaining fluid residuals inside said internal volume when said beverage extraction has been terminated.

6. The cartridge according to claim 5, wherein said septum is made of a Styrene-Ethylene-Butylene-Styrene rubber.

7. The cartridge of claim 5, wherein said septum is sized so as to fluid-tight fit with the internal surface of the cup port.

8. The cartridge of claim 7, wherein said septum comprises annular ribs on its lateral surface, so as to provide a fluid-tight engagement with the internal surface of the cup port.

9. The cartridge of claim 5, wherein said septum is stacked on an annular support, which comprises said snap-fit means.

10. The cartridge of claim 2, wherein said snap-fit means comprise an annular protrusion which surrounds said valve means and which is engaged with a corresponding annular recess on the internal surface of said cup port.

11. The cartridge of claim 1, wherein said cap sidewall comprises a means for fixedly engaging with the external surface of the cup port.

12. The cartridge of claim 11, wherein said means for fixedly engaging the cap with the external surface of the cup port comprises at least one annular rib which engages with a corresponding annular rib that surrounds the external surface of said cup port.

13. The cartridge according to claim 1, wherein said at least one bottom aperture of said safety cap is partially surrounded by opposite vertical walls extending from said base at said second annular area.

14. The cartridge according to claim 1, wherein said base comprises a plurality of ridges directly formed thereon and protruding towards the internal volume of the cartridge, so as to define a plurality of concentric and radial channels for conveying the extracted beverage to the cup port.

15. The cartridge according to claim 1, wherein said cup port has a substantially cylindrical shape.

16. The cartridge according to claim 1, wherein said main body has a substantially cylindrical shape.

17. The cartridge according to claim 1, wherein said cartridge is made of any material selected from the group comprising: thermoplastics, aluminum, rubber, polylaminate plastics, thermosetting compositions and any combination thereof.

18. The cartridge according to claim 1, wherein said edible substance is selected from the group comprising: ground coffee, roasted ground coffee, instant coffee, tea, powdered chocolate, powdered milk, instant based brews or soups.

19. An extraction assembly to be mounted on beverage extraction machines, comprising a support connectable to a water outlet of a beverage extraction machine and a cartridge holder securable to said support and holding a cartridge according to claim 1.

* * * * *